US007263849B2

(12) United States Patent
Shin et al.

(10) Patent No.: US 7,263,849 B2
(45) Date of Patent: Sep. 4, 2007

(54) REFRIGERATING SYSTEM FOR REFRIGERATOR

(75) Inventors: Jong Min Shin, Busan (KR); Hyeon Kim, Gyeongsangnam-do (KR); Sung Hee Kang, Gyeongsangnam-do (KR); Jun Hyun Hwang, Gyeongsangnam-do (KR); Jong Kwon Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 138 days.

(21) Appl. No.: 11/145,188

(22) Filed: Jun. 6, 2005

(65) Prior Publication Data

US 2006/0048529 A1 Mar. 9, 2006

(30) Foreign Application Priority Data

Dec. 29, 2003 (KR) ..... 2003-94591

(51) Int. Cl.
*F25B 41/04* (2006.01)
*F25B 49/00* (2006.01)

(52) U.S. Cl. ..... 62/222; 62/228.3

(58) Field of Classification Search ..... 62/158, 62/199, 202, 204, 210, 215, 216, 222, 228.3
See application file for complete search history.

(56) References Cited

U.S. PATENT DOCUMENTS 3,365,902 A * 1/1968 Nussbaum ..... 62/155
3,763,659 A * 10/1973 Hover ..... 62/115
3,842,616 A * 10/1974 Orbesen ..... 62/225
3,921,413 A * 11/1975 Kohlbeck ..... 62/173
4,270,363 A * 6/1981 Maring et al. ..... 62/179
4,854,130 A * 8/1989 Naruse et al. ..... 62/352
4,862,702 A * 9/1989 O'Neal ..... 62/196.4
4,938,032 A * 7/1990 Mudford ..... 62/160
5,070,707 A * 12/1991 Ni ..... 62/234
5,156,017 A * 10/1992 Smith et al. ..... 62/210
5,168,715 A * 12/1992 Nakao et al. ..... 62/181
5,937,658 A * 8/1999 Black et al. ..... 62/73
6,837,061 B2 * 1/2005 Kadle et al. ..... 62/158

FOREIGN PATENT DOCUMENTS

JP 7-318178 A * 12/1995
JP 8-271065 A * 10/1996
JP 2000-180013 6/2000
KR 1999-0071303 9/1999
SU 1244446 A1 * 7/1986

* cited by examiner

*Primary Examiner*—Mohammad M. Ali
(74) *Attorney, Agent, or Firm*—Ked & Associates, LLP

(57) ABSTRACT

A refrigerating system for a refrigerator is disclosed. The refrigerator includes a compressor that compresses refrigerant, a condenser connected to the compressor that condenses compressed refrigerant, an expansion valve connected to the condenser that expands condensed refrigerant, freezing chamber and refrigerating chamber evaporators connected to the expansion valve that cool air in a freezing chamber and a refrigerating chamber by using refrigerant, respectively, and a regulating valve between the condenser and the refrigerating chamber evaporator that regulates refrigerant supply to the refrigerating chamber evaporator, thereby providing a refrigerating system for a refrigerator having high efficiency.

11 Claims, 3 Drawing Sheets

REFRIGERATING SYSTEM FOR REFRIGERATOR

BACKGROUND OF THE INVENTION

1. Field of the Invention

The present invention relates to refrigerating systems for refrigerators, and more particularly, to a control method at the time of initial operation of a refrigerating system.

2. Discussion of the Related Art

In general, the refrigerator cools a space thereof for fresh storage of food therein for a time period while refrigerant (working fluid) repeats a refrigerating cycle of compression-condensing-expansion-evaporation.

Of the refrigerators, a direct cooling type refrigerator is provided with separate evaporators for a freezing chamber and a refrigerating chamber respectively. The direct cooling type refrigerator will be described in detail with reference to FIG. 1.

The refrigerating system of the direct cooling type refrigerator is provided with a compressor 11, a condenser 12, an expansion valve 13, a freezing chamber evaporator 14, and a refrigerating chamber evaporator 15. Various units of the refrigerating system are connected with refrigerant pipes 16.

The compressor 11 compresses low temperature/low pressure refrigerant gas to a high temperature/high pressure refrigerant gas. The condenser 12 receives and compresses refrigerant from the compressor 11. The expansion valve 13 receives refrigerant from the condenser 12 and drops a pressure of the refrigerant. The freezing chamber evaporator 14 and the refrigerating evaporator 15 evaporate the refrigerant from the expansion valve 13 in a low pressure state, to absorb heat from air in the vicinity of the evaporators 14, and 15. Air cooled down by the evaporators 14, and 15 is supplied to the freezing chamber and the refrigerating chamber for fresh storage of food. Above cycle is repeated continuously while the refrigerator is operated.

However, the substantially long refrigerant pipes 16 of the refrigerating system of the related art direct cooling type refrigerator due to the two evaporators 14, and 15 requires large quantity of refrigerant filled in the refrigerating system. Therefore, even though a high torque is not required for the compressor 11 once operation of the refrigerating system is stabilized after the refrigerating system is operated for a certain time period, a high torque, with consequential high voltage, is required when the refrigerating system starts operation, i.e., the compressor 11 starts operation. That is, the related art refrigerating system uses a compressor of which torque is high unnecessarily due to above initial operation problem.

SUMMARY OF THE INVENTION

Accordingly, the present invention is directed to a refrigerating system that substantially obviates one or more problems due to limitations and disadvantages of the related art.

An object of the present invention is to provide a refrigerating system which can drop a torque and a voltage required for a compressor at starting of operation.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerating system for a refrigerator includes a compressor for compressing refrigerant, a condenser connected to the compressor for condensing compressed refrigerant, an expansion valve connected to the condenser for expanding condensed refrigerant, freezing chamber, and refrigerating chamber evaporators connected to the expansion valve for cooling air in a freezing chamber and a refrigerating chamber by using refrigerant respectively, and a regulating valve between the condenser and the refrigerating chamber evaporator for regulating refrigerant supply to the refrigerating chamber evaporator.

The regulating valve is configured such that the refrigerant supply to the refrigerating chamber evaporator is permitted, selectively. In such a selective refrigerant supply, at first, the regulating valve cuts off the refrigerant supply to the refrigerating chamber evaporator when the compressor is operated initially. Moreover, the regulating valve permits the refrigerant supply to the refrigerating chamber evaporator when operation of the compressor is stabilized. For an example, the regulating valve may permit the refrigerant supply to the refrigerating chamber evaporator when a predetermined time period passes after operation of the compressor starts, or a torque of the compressor becomes constant.

Alternatively, the regulating valve may be configured such that the regulating valve increase the refrigerant supply to the refrigerating chamber evaporator gradually after operation of the refrigerating system starts. In this case, the regulating valve is valve configured to regulate a degree of opening of a flow passage connected to the refrigerating chamber evaporator.

The expansion valve includes a first expansion valve for expanding refrigerant to the freezing chamber evaporator, and a second expansion valve for expanding refrigerant to the refrigerating chamber evaporator. In this case, more specifically, the regulating valve is provided between the refrigerating chamber evaporator and the second expansion valve.

Thus, the present invention enables to reduce a production cost of the refrigerating system and increases efficiency of the refrigerating system.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
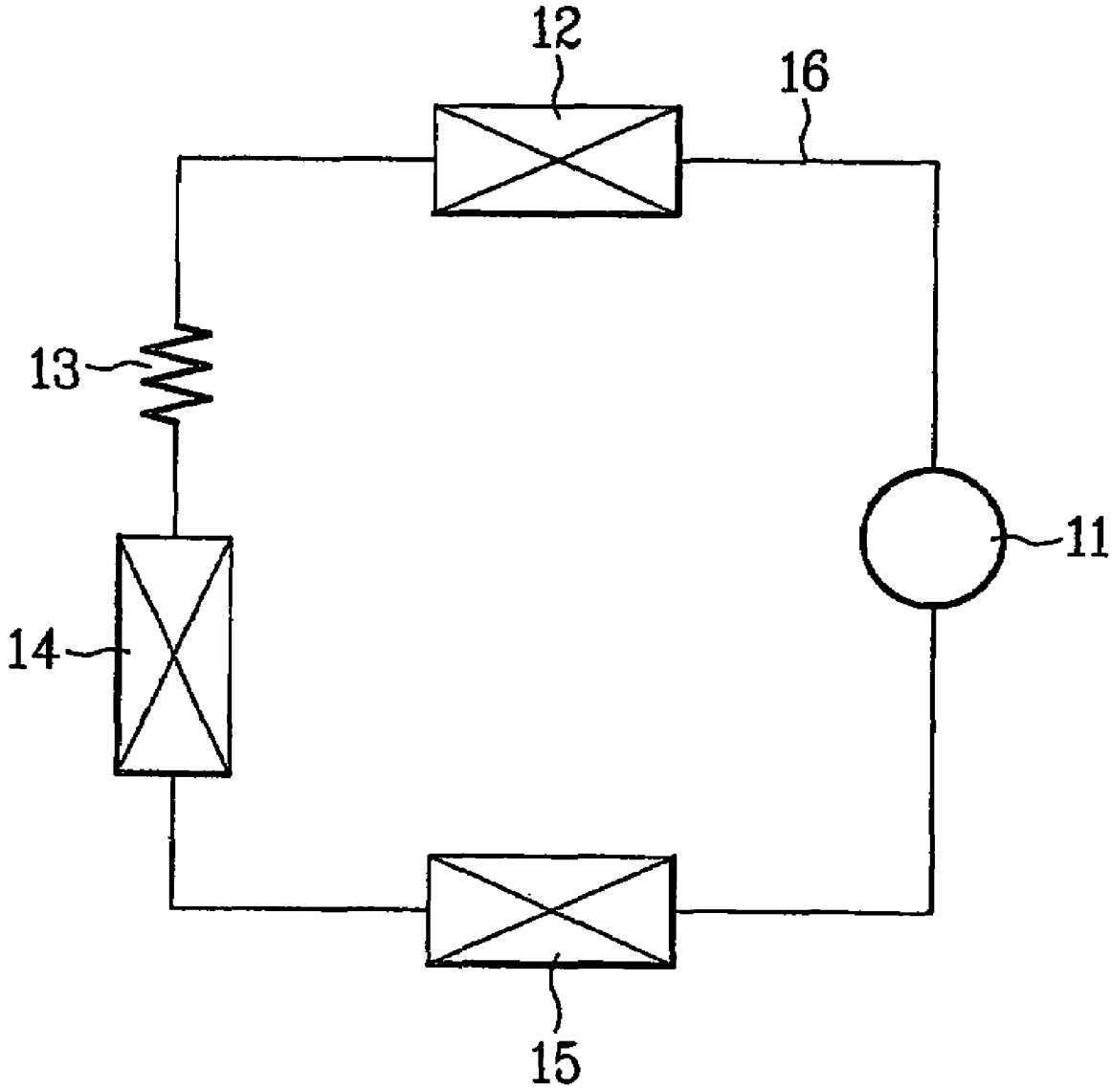
FIG. 1 illustrates a diagram of a related art refrigerating system of a refrigerator, schematically.
Figure 2:
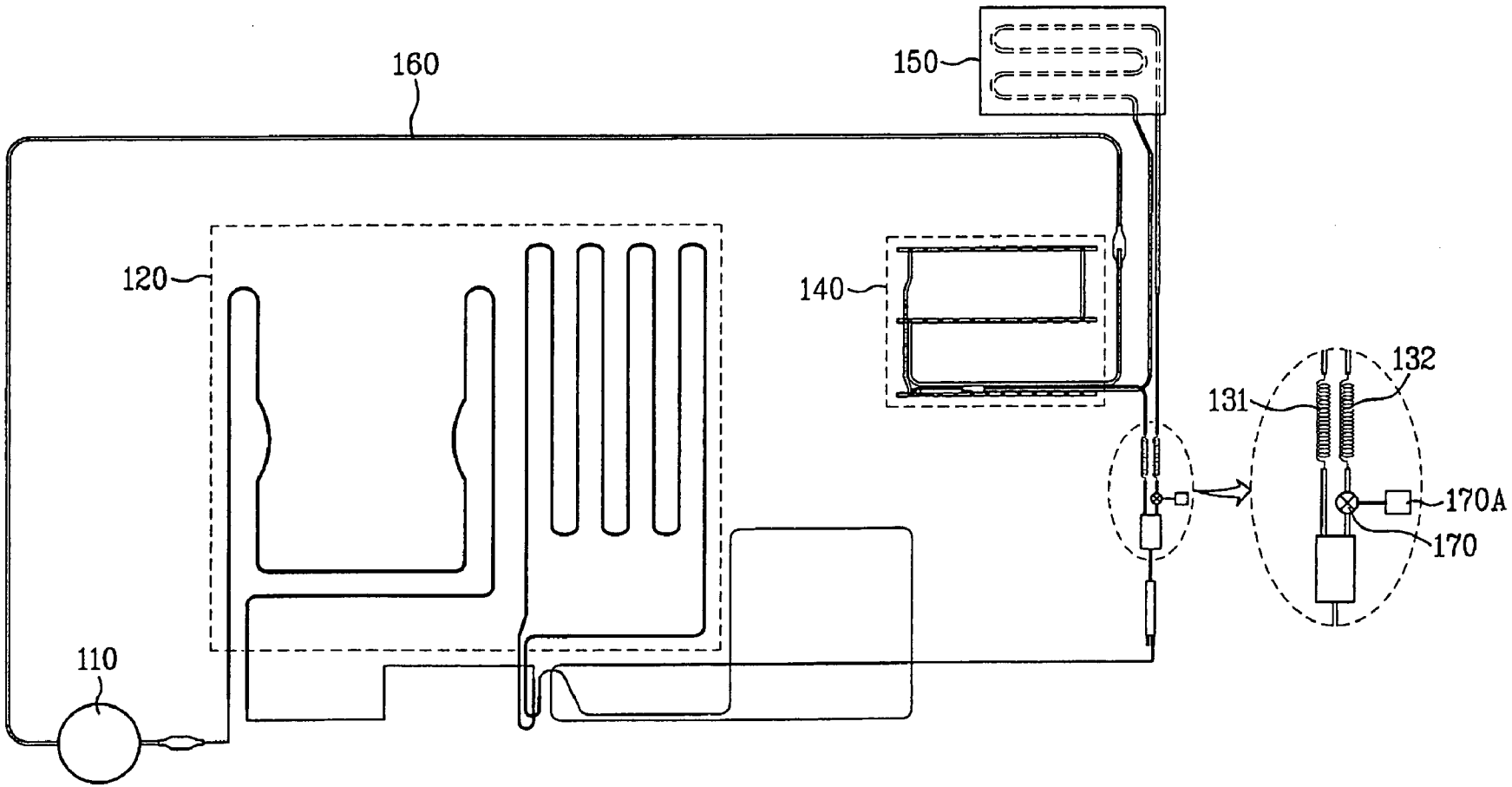
FIG. 2 illustrates a diagram of a refrigerating system of a refrigerator in accordance with a preferred embodiment of the present invention.
Figure 3:
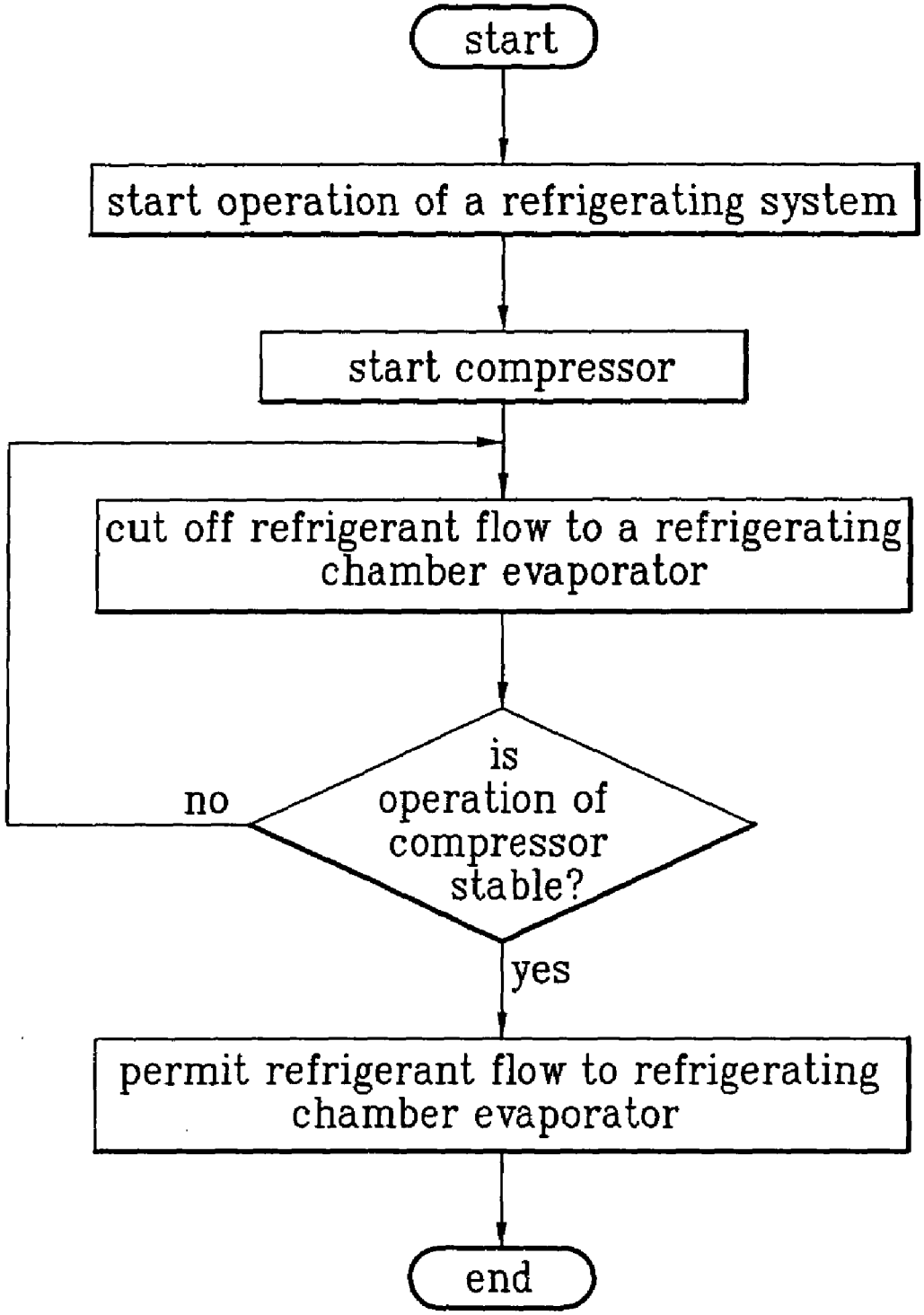
FIG. 3 illustrates a flow chart showing the steps of a process for operating a refrigerating system in accordance with a preferred embodiment of the present invention.

FIG. 2 illustrates a diagram of a refrigerating system of a refrigerator in accordance with a preferred embodiment of the present invention, and FIG. 3 illustrates a flow chart showing the steps of a process for operating a refrigerating system in accordance with a preferred embodiment of the present invention.

The refrigerating system of the present invention includes a refrigerant pipe 160, a compressor 110, a condenser 120, a freezing chamber expansion valve 131, a refrigerating chamber expansion valve 132, a freezing chamber evaporator 140, and a refrigerating chamber evaporator 150, and a regulating valve 170.

Basically, the refrigerant pipe 160, the compressor 110, and the condenser 120 are the same with the related art. The refrigerant pipe 160 guides refrigerant to various units of the refrigerating system, the compressor 110 is connected to the refrigerant pipe 160 for compressing refrigerant flowing through the refrigerant pipe 160, and the condenser 120 condenses refrigerant compressed at the compressor 110.

However, in the present invention, the expansion valves 131, and 132 are connected to the evaporators 140, and 150 respectively, and supply of refrigerant to the refrigerating chamber expansion valve 132 connected to the refrigerating chamber evaporator 150 is made selectively. For such a supply, the regulating valve 170 is mounted in the refrigerating pipe 160 connecting the condenser 120 and the refrigerating chamber evaporator 150. Particularly, it is preferable that the regulating valve 170 is mounted between the condenser 120 and the refrigerating chamber expansion valve 132 for making selective flow of refrigerant to the refrigerating chamber expansion valve 132.

In accordance with signals from a regulating valve controller 170A, the regulating valve 170 opens/closes the refrigerant pipe 160 selectively, for regulating supply of the refrigerant to the refrigerating chamber evaporator 150. In more detail, at an initial operation of the refrigerating system, the regulating valve 170 cuts off refrigerant flow to the refrigerating chamber evaporator, specifically, to the refrigerating chamber expansion valve 132. According to this, in the refrigerating system of the present invention, a circulating distance of refrigerant becomes the shortest, and a voltage and a torque required for starting of the compressor 110 are minimized, accordingly.

For regulating the circulating distance of the refrigerant, though not shown, the regulating valve 170 may regulate refrigerant supply to the freezing chamber evaporator 140 instead of the refrigerating chamber evaporator, or refrigerant supply both to the refrigerating chamber and the freezing chamber 140, and 150. However, in general, since it is required that a temperature of the freezing chamber is maintained lower than a temperature of the refrigerating chamber, it is required that expanded refrigerant is supplied to the freezing chamber evaporator 140 at first. Under this reason, it is not preferable to cut off an initial refrigerant supply to the refrigerating chamber evaporator 150 for stable operation of the refrigerating system. Therefore, as described, the cutting off of the initial refrigerant supply to the refrigerating chamber evaporator 150 is advantageous both in view of making the refrigerant circulating distance the shortest, and stability of the refrigerating system operation.

The steps of operation of the refrigerating system of the direct cooling type refrigerator of the present invention will be described in detail, with reference to FIG. 3.

Upon putting the refrigerating system into operation, the compressor 110 is started to compress refrigerant. The torque and voltage required for starting the compressor 110 is dependent on a length of the refrigerant pipe 160, particularly, a refrigerant circulating distance.

In the present invention, when operation of the refrigerating system is started, i.e., when initial starting of the compressor 110 is made, the refrigerant chamber expansion valve 132 is closed by the regulating valve 170, to shorten the refrigerant flow distance in the refrigerating system, significantly. That is, the refrigerant flows not through the refrigerating chamber expansion valve 132 and the refrigerating chamber evaporator 150, but through the freezing chamber expansion valve 131 and the freezing chamber evaporator 140 only, a total flow distance (i.e., a circulating distance) is shortened. According to this, the torque required for initial starting of the compressor 110 is reduced in proportion to the shortened flow distance of the refrigerant.

Thereafter, when operation of the compressor 110 is stabilized, the regulating valve 170 is operated, to open a flow passage to the refrigerating chamber expansion valve 132.

In this instance, if the torque of the compressor 110 shows no change, it may be considered that the compressor 110 is in a stable state. Moreover, only with no sudden increase of the torque of the compressor 110, the stable state of the compressor 110 can be identified. On the other hand, if a preset time period passes after putting the compressor 110 into operation, it may be considered that operation of the compressor 110 is reached to the stable state.

At the end, as the refrigerant flow to the refrigerating chamber evaporator 150 is performed according to the foregoing series of steps, to make heat exchange at the freezing chamber evaporator 140 and the refrigerating chamber evaporator 150 at the same time, stable supply of cold air to the freezing chamber and the refrigerating chamber is made.

Alternatively, instead of supplying refrigerant to the refrigerating chamber evaporator 150 only when the operation of the compressor 110 is stabilized, the refrigerant supply to the refrigerant chamber evaporator 150 may be increased gradually, to prevent momentary torque increase of the compressor 110 caused by sudden refrigerant flow path change from occurring. For such a refrigerant supply control, the regulating valve 170 is not a general valve that only opens/closes a flow passage simply, but a valve that can adjust a degree of opening of the flow passage.

In this case, at initial operation of the refrigerating system, i.e., at initial operation of the compressor 110, refrigerant supply to the refrigerating chamber evaporator 150 is cut off completely, and is increased, gradually. Finally, when the refrigerating system, i.e., the compressor 110, reaches to a stable state, refrigerant is supplied to the refrigerating chamber evaporator 150 fully. In more detail, at the time of initial starting of the compressor 110, the regulating valve 170 closes the refrigerant pipe 160 completely, and then, the regulating valve 170 increases the degree of opening of the refrigerant pipe gradually in a predetermined time period. If the operation of the compressor 110 reaches to a stable state fully, the regulating valve 170 opens the refrigerant pipe 160, fully.

As has been described, by regulating refrigerant supply to the refrigerating chamber evaporator, the refrigerating system of the present invention can reduce a torque required for initial operation of the compressor. Accordingly, the use of a compressor requiring a relatively low torque permits to reduce a production cost of the refrigerating system, and increase efficiency of the refrigerating system owing to a low power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerating system for a refrigerator, comprising:

a compressor configured to compress refrigerant;

a condenser connected to the compressor configured to condense compressed refrigerant;

an expansion valve connected to the condenser configured to expand condensed refrigerant;

freezing chamber and refrigerating chamber evaporators connected to the expansion valve configured to cool air in a freezing chamber and a refrigerating chamber by using refrigerant, respectively; and a regulating valve between the condenser and the refrigerating chamber evaporator configured to regulate refrigerant supply to the refrigerating chamber evaporator, wherein the regulating valve is configured such that the refrigerant supply to the refrigerating chamber evaporator is permitted selectively, to reduce the torque required for initial starting of the compressor.

2. The refrigerating system as claimed in claim 1, wherein the regulating valve cuts off the refrigerant supply to the refrigerating chamber evaporator when the compressor is operated initially.

3. The refrigerating system as claimed in claim 1, wherein the regulating valve permits the refrigerant supply to the refrigerating chamber evaporator when the operation of the compressor is stabilized.

4. The refrigerating system as claimed in claim 1, wherein the regulating valve permits the refrigerant supply to the refrigerating chamber evaporator when a predetermined time period passes after operation of the compressor starts.

5. The refrigerating system as claimed in claim 1, wherein the regulating valve permits the refrigerant supply to the refrigerating chamber evaporator when a torque of the compressor becomes constant.

6. The refrigerating system as claimed in claim 1, wherein the regulating valve is configured such that the regulating valve increase the refrigerant supply to the refrigerating chamber evaporator gradually after operation of the refrigerating system starts.

7. The refrigerating system as claimed in claim 1, wherein the regulating valve is configured to regulate a degree of opening of a flow passage connected to the refrigerating chamber evaporator.

8. The refrigerating system as claimed in claim 1, wherein the expansion valve comprises:

a first expansion valve configured to expand refrigerant to the freezing chamber evaporator; and a second expansion valve configured to expand refrigerant to the refrigerating chamber evaporator.

9. The refrigerating system as claimed in claim 8, wherein the regulating valve is provided between the refrigerating chamber evaporator and the second expansion valve.

10. The refrigerating system as claimed in claim 1, wherein the regulating valve regulates refrigerant supply such that no excessive load is put on the compressor at the time of initial operation of the refrigerating system.

11. The refrigerating system as claimed in claim 1, wherein the regulating valve supplies refrigerant to the refrigerating chamber evaporator selectively depending on an operation state of the compressor.

* * * * *